US011447948B1

(12) United States Patent
Hohmann, Jr.

(10) Patent No.: US 11,447,948 B1
(45) Date of Patent: Sep. 20, 2022

(54) VENEER TIES HAVING ASYMMETRICAL TRANSVERSE CROSS-SECTIONS AND WALL ANCHORING SYSTEM UTILIZING THE SAME

(71) Applicant: Ronald Hohmann, Jr., Lakewood Ranch, FL (US)

(72) Inventor: Ronald Hohmann, Jr., Lakewood Ranch, FL (US)

( * ) Notice: Subject to any disclaimer, the term of this patent is extended or adjusted under 35 U.S.C. 154(b) by 0 days.

(21) Appl. No.: 17/362,845

(22) Filed: Jun. 29, 2021

(51) Int. Cl.
*E04B 1/41* (2006.01)

(52) U.S. Cl.
CPC ..... *E04B 1/4185* (2013.01)

(58) Field of Classification Search
USPC ..... 52/319, 408, 513, 712
See application file for complete search history.

(56) References Cited

U.S. PATENT DOCUMENTS 3,966,420 A * 6/1976 Pegels ..... B01J 8/125 422/607
4,213,024 A * 7/1980 Costley ..... B23K 9/0203 219/137 R
4,244,172 A * 1/1981 Glushko ..... D07B 5/10 57/215
RE30,593 E * 4/1981 Wallshein ..... A61C 7/12 433/20
4,327,244 A * 4/1982 Horvath ..... H01B 12/02 174/15.5
5,379,567 A * 1/1995 Vahey ..... E04C 3/07 52/843
5,496,969 A * 3/1996 Blackmore ..... H01B 5/08 174/113 A
5,597,959 A * 1/1997 Rice ..... G01N 3/20 73/827
6,973,756 B2 12/2005 Hatzinikolas
7,415,803 B2 8/2008 Bronner
8,613,175 B2 * 12/2013 Hohmann, Jr. ..... E04B 1/4178 52/712
D702,544 S 4/2014 Hohmann, Jr.
8,726,596 B2 5/2014 Hohmann, Jr.
8,726,597 B2 5/2014 Hohmann, Jr.
8,733,049 B2 * 5/2014 Hohmann, Jr. ..... E04B 1/4178 52/712
8,739,485 B2 * 6/2014 Hohmann, Jr. ..... E04B 1/4178 52/513
8,833,003 B1 9/2014 Hohmann, Jr.
8,863,469 B2 10/2014 Curtis et al.
(Continued)

*Primary Examiner* — Joshua K Ihezie
(74) *Attorney, Agent, or Firm* — Derek Fahey, Esq.; The Plus IP Firm, PLLC

(57) ABSTRACT

The veneer tie having a first end portion for being disposed in an outer wythe. A first leg and second leg of the veneer tie are vertically arranged, and both the first leg and second leg have a first transverse cross section that are asymmetrical. A first arm and a second arm of the veneer tie are horizontally arranged. The first arm and the second arm include a second transverse cross section. The second transverse cross section is different than the first transverse cross section of the first leg and second leg. A first end of the first arm and a first end of the second arm is adjoined to the first end portion. A joint portion adjoins a second end of the first arm and a second end of the second arm to an upper end of the first leg and an upper end of the second leg, respectively.

10 Claims, 9 Drawing Sheets

(56) References Cited

U.S. PATENT DOCUMENTS

| | | | | |
|---|---|---|---|---|
| 8,881,488 | B2 | 11/2014 | Hohmann, Jr. | |
| 8,893,452 | B2 | 11/2014 | Hatzinikolas | |
| 8,898,980 | B2 * | 12/2014 | Hohmann, Jr. | E04B 1/4178 52/712 |
| 8,904,726 | B1 * | 12/2014 | Hohmann, Jr. | E04B 1/4178 52/712 |
| 8,904,727 | B1 * | 12/2014 | Hohmann, Jr. | E04B 1/4178 52/712 |
| 8,978,330 | B2 * | 3/2015 | Hohmann, Jr. | E04B 1/4178 52/513 |
| 9,140,001 | B1 | 9/2015 | Hohmann, Jr. | |
| 9,273,461 | B1 | 3/2016 | Hohmann, Jr. | |
| 9,803,355 | B1 | 10/2017 | Ripley et al. | |
| 9,945,414 | B1 | 4/2018 | Rodenhouse et al. | |
| 10,202,754 | B2 | 2/2019 | Hohmann, Jr. | |
| D848,250 | S | 5/2019 | Ripley et al. | |
| 11,189,394 | B2 * | 11/2021 | Sahashi | H01B 13/0006 |
| 2013/0074435 | A1 * | 3/2013 | Hohmann, Jr. | E04B 1/4178 52/565 |
| 2013/0074442 | A1 * | 3/2013 | Hohmann, Jr. | E04B 1/4178 52/712 |
| 2014/0075856 | A1 * | 3/2014 | Hohmann, Jr. | E04B 1/4178 52/167.1 |
| 2015/0121792 | A1 | 5/2015 | Spoo et al. | |

* cited by examiner

VENEER TIES HAVING ASYMMETRICAL TRANSVERSE CROSS-SECTIONS AND WALL ANCHORING SYSTEM UTILIZING THE SAME

CROSS-REFERENCE TO RELATED APPLICATIONS

Not applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates generally to a veneer wall anchoring system with veneer ties. More specifically, the present invention relates to a veneer tie that is operable with a wall system to tie an outer wythe to an inner wythe of a building.

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Often, masonry veneer tied to a backup wall are commonly used in construction to provide for an aesthetically pleasing appearance, while being less expensive than solid masonry walls. One common type of veneer wall is a brick veneer tied to a stud back-up wall. Typically, with modern construction techniques, it is a common practice to enclose the framing of a building with a masonry veneer wall. Many architects and engineers firmly believe that masonry wall cracking would be reduced to a minimum if walls were permitted more freedom of movement. Accordingly, systems have been heretofore designed to provide lateral restraint while permitting horizontal and vertical movement.

Unfortunately, lateral forces, such as wind, apply lateral, compressive, and tensile forces across veneer masonry. It is also recognized that failures of veneer ties often occur at the junction points, which can include the connective region between the inner and outer wythes.

Some prior art has attempted to address the need for improved strength of veneer ties. For example, U.S. Pat. No. 8,726,596 to Hohmann attempts to improve the strength of an anchoring system by flattening surfaces of the veneer tie. However, there still a need for improving the strength of the veneer ties over the teachings of U.S. Pat. No. 8,726,596. Other prior art has involved veneer anchors for masonry veneer wall systems. The problem with these anchoring devices is that they are not sufficiently strong enough to resist lateral forces against the veneer wall.

As a result, there exists a need for improvements over the prior art and more particularly other apparatus, methods and systems for improving the strength of the anchoring systems.

SUMMARY

A veneer tie and anchoring system having an asymmetrical transverse cross-section is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a veneer tie is disclosed. The veneer tie includes a first end portion for being disposed in a bed joint of an outer wythe. A second end portion defining a first leg and a second leg. The first leg and the second leg are vertically arranged. The first leg and the second leg include a first transverse cross section having a first transverse cross section first side and a first transverse cross section second side, wherein the first side and the second side are asymmetrical. A first arm and a second arm. The first arm and the second arm are horizontally arranged. The first arm and the second arm include a second transverse cross section. The second transverse cross section is different than the first transverse cross section. A first end of the first arm and a first end of the second arm is adjoined to the first end portion. A joint portion adjoining a second end of the first arm and a second end of the second arm to an upper end of the first leg and an upper end of the second leg, respectively.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
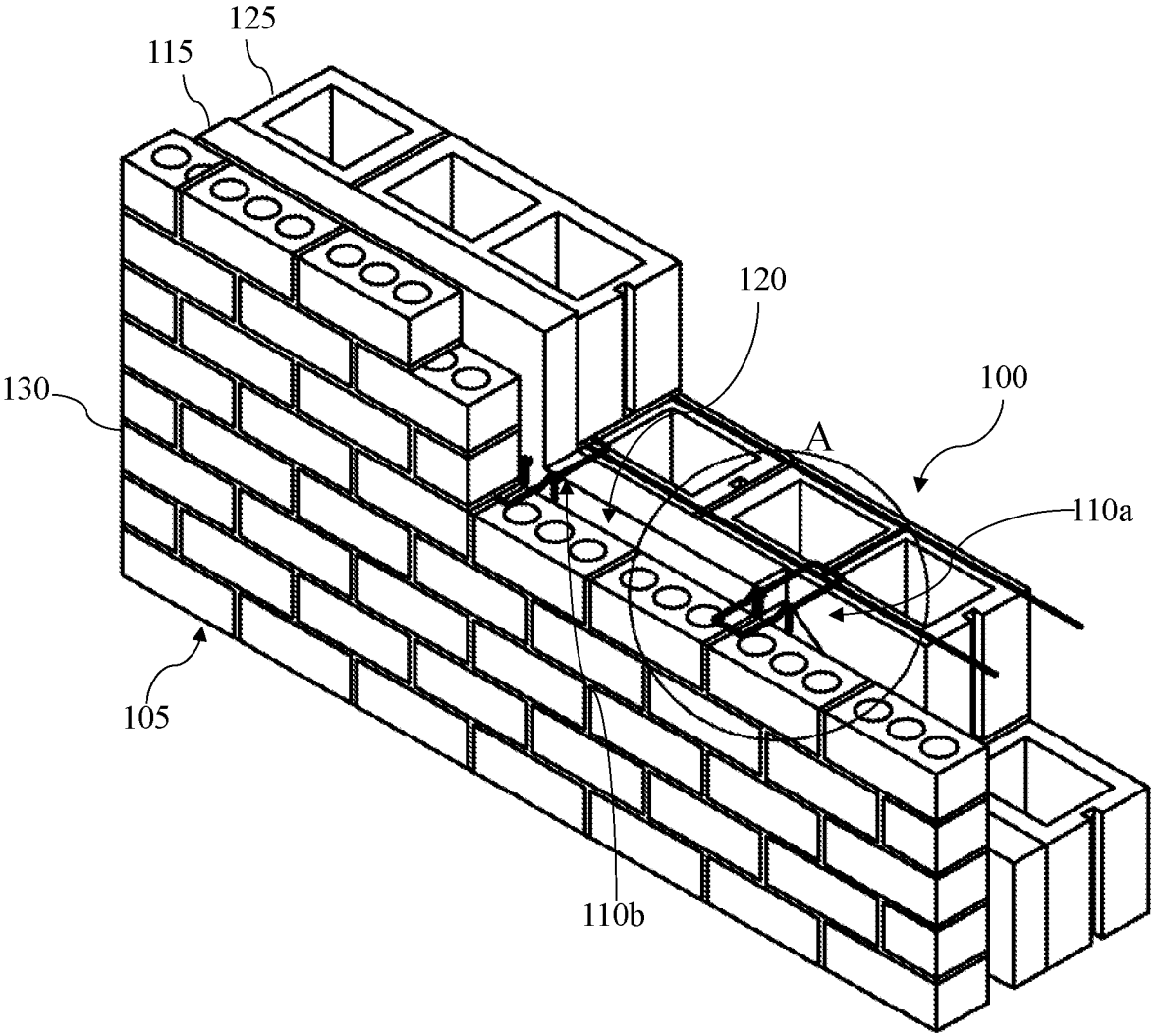
FIG. 1 illustrates a perspective view of an exemplary veneer wall anchoring system anchored to a wall system, in accordance with an embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a veneer tie with vertically arranged legs having an asymmetrical transverse cross-section to be used with a wall anchoring system. Illustrative embodiments of the disclosure are generally directed to a veneer wall anchoring system with asymmetrical veneer tie and method of use. The veneer wall anchoring system includes an asymmetrical veneer tie configured to tie an outer wythe, such as a masonry veneer wall, to an inner wythe of a wall system. The asymmetrical veneer tie includes a specially dimensioned asymmetrical cross-section at connective points. The cross-sectional dimensions are configured with tapered ends, shoulders, and curved sides that increase contact forces and frictional contact points. Such an asymmetrical shape works to enhance resistance to compressive and tensile forces generated by lateral loads on the outer wythe of the wall system.

In some embodiments, a veneer wall anchoring system provides an asymmetrical veneer tie that is operable to strengthen the structure of a wall system, which has an inner wythe and an outer wythe. In alternative embodiments, a cavity forms between the inner and outer wythes. In alternative embodiments, an insulative panel positions within the cavity.

In some embodiments, the asymmetrical veneer tie comprises a wall anchor that is configured to be fixedly attached to the inner wythe. The wall anchor has at least one receiving portion. In some embodiments, the receiving portion defines an eye, circle, eyelet, or other ring-like shape. The receiving portion is disposed horizontally inside the cavity.

Operable with the wall anchor is an asymmetrical veneer tie. The veneer tie is uniquely defined by an asymmetrical transverse cross section. In some embodiments, the veneer tie is received by the at least one receiving portion of the wall anchor, which creates a secure connection therebetween. In some embodiments, the asymmetrical veneer tie comprises a first end portion that is configured to be disposed in a bed joint of the outer wythe. In this arrangement, the first end portion is the portion of the veneer tie that engages the outer wythe, or veneer wall.

In some embodiments, the veneer tie also comprises a second end portion. The second end portion has a first leg and an opposing, parallel second leg. The first leg and the second leg are vertically arranged, relative to the wall system. In other embodiments, the first leg and the second leg each have a first transverse cross section. The first transverse cross section has a first transverse cross section first side and a first transverse cross section second side, which are asymmetrical to each other. In this configuration, the first transverse cross section is introduced inside of the eye that forms in the receiving portion. The asymmetric shape strengthens the connection therebetween.

The veneer tie also has a first arm and a second arm, which are horizontally arranged, relative to the wall system. In one embodiment, a first end of the first arm, and a first end of the second arm are adjoined to the first end portion of the veneer tie. In other embodiments, the first arm and the second arm comprise a second transverse cross section. The second transverse cross section is different than the first transverse cross section. For example, the second transverse cross section can be symmetrical.

The second end portion also has a joint portion that serves as a nexus to adjoin a second end of the first arm and a second end of the second arm to an upper end of the first leg and an upper end of the second leg, respectively. In another aspect, the first transverse cross section second side is arranged such that it is distal to the first end portion of the veneer tie. In one embodiment, the first transverse cross section defines at least one shoulder. In another aspect, the first transverse cross section defines a tapered section on the first transverse cross section first side. In another aspect, the first transverse cross section defines a curved shaped on the first transverse cross section second side.

In another aspect, the wall system further comprises an insulation panel disposed between the inner wythe and the outer wythe. In another aspect, the first transverse cross section first side and the first transverse cross section second side have a midline. One objective of the present invention is to strengthen the outer wythe, or veneer wall, against compressive and tensile forces generated by lateral loads on the outer wythe of the wall system. Another objective is to fabricate the veneer tie through cold-working to increase tensile and compressive strength. Another objective is to provide an asymmetrical connection between the legs and the receiving portion of the wall anchor. Yet another objective is to more securely tie a veneer wall to a framework of a building. An exemplary objective is to provide a veneer tie that is easy to introduce into a wall system. Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Referring now to the Figures, a veneer wall anchoring system 100 with asymmetrical veneer tie and method of use is referenced in FIGS. 1-13. The veneer wall anchoring system 100 is designed to help anchor an outer wythe, or veneer masonry, to an adjacent inner wythe, such as an adjacent stud wall or dry wall. The veneer wall anchoring system, hereafter "system" includes at least one asymmetrical veneer tie 110*a*, 110*b* that is operable with a wall system 105 to tie together the inner wythe 125 and outer wythe 130, 130. The asymmetrical veneer tie 110*a* includes a pair of legs 210*a*, 210*b* that cooperate with a first end portion 200 of the veneer tie 110*a*. The legs 210*a-b* define one or more asymmetrical cross-sections, which are designed to strengthen the anchoring capacity of the veneer tie 110*a*. In other words, each of the legs are have at least a portion of the leg having an asymmetrical cross-section. In some embodiments, the shapes of the cross-sectional dimensions define: tapered ends, shoulders, and curved sides, which are designed to increase contact forces and frictional contact points. In this manner, the asymmetrical configuration of the veneer tie 110*a* strengthens resistance to compressive and tensile forces generated by lateral loads on the outer wythe.

As referenced in FIG. 1, the system 100 provides at least one asymmetrical veneer tie 110*a*, 110*b* that is operable to strengthen the structure of a wall system 105. In some embodiments, the wall system 105 includes an inner wythe 125 and an outer wythe 130. The inner wythe 125 may include a drywall or other supportive framework. The outer wythe 130 may include, without limitation, a brick masonry veneer. In one possible embodiment, a cavity 120 forms between the inner wythe 125 and outer wythes 130. In alternative embodiments, an insulation panel 115 positions within the cavity 120.

Figure 2:
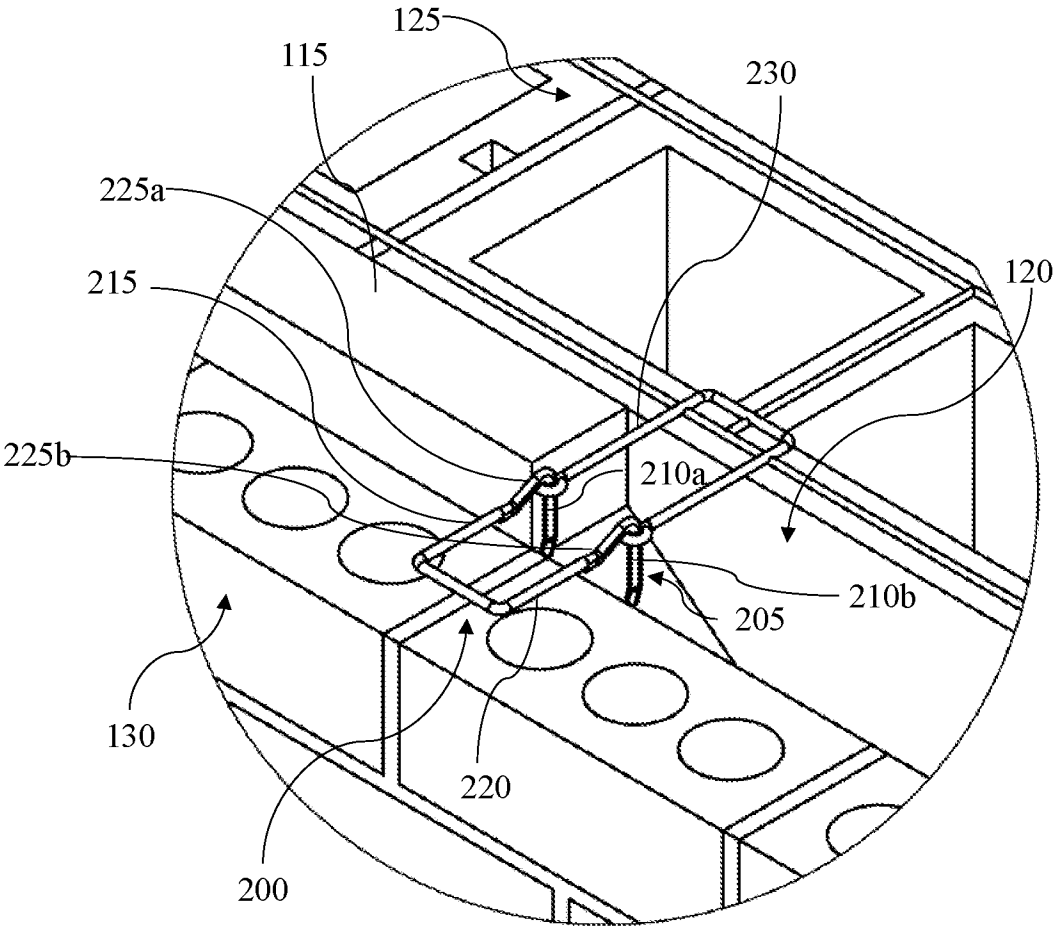
FIG. 2 illustrates a close-up view of the veneer wall anchoring system shown in Circle A of FIG. 1, in accordance with an embodiment of the present invention.

Turning now to FIG. 2, the veneer tie 110*a* has a first end portion 200 that embeds into the outer wythe 130. The veneer tie 110*a* also has a wall anchor 230 that embeds into the inner wythe 125. The veneer tie 110*a* extends across the cavity 120, with the first and second legs 210*a-b* introduced into the cavity 120 therebetween. Significantly, the legs 210*a-b* couple to a receiving portion of the wall anchor 230. In the present embodiment, the wall anchor is generally described as a u-shaped wire body have eyelets or opening at the ends of the u-shaped body. The eyelets act as receiving portions to receive the vertically arranged legs of the veneer tie. However, it is understood that other shapes and embodiments of the wall anchor may be used and are within the spirit and scope of the present invention.

Those skilled in the art will recognize that lateral forces, such as wind, apply lateral, compressive, and tensile forces across veneer masonry. It is also recognized that failures of veneer ties often occur at the junction points, which can include the connective region between the inner and outer wythes. In one embodiment, the present disclosure addresses the need for a stronger fitted connection between the legs and the first end portion of the veneer tie, as defined below.

Figure 3:
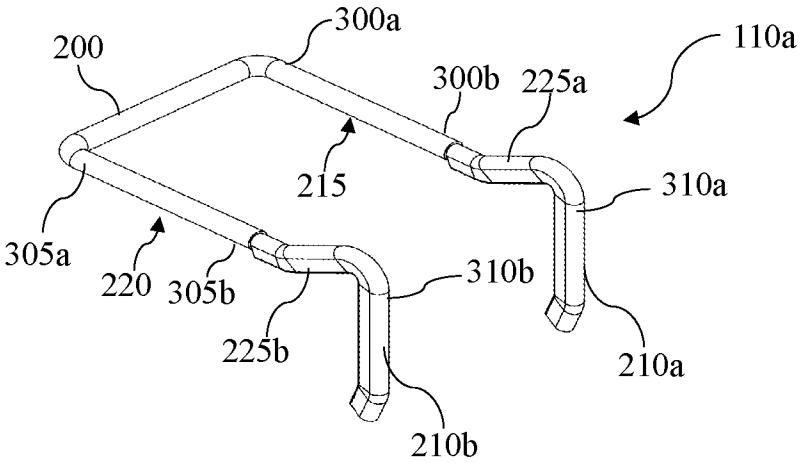
FIG. 3 illustrates a perspective view of a veneer tie, in accordance with an embodiment of the present invention.
Figure 4:
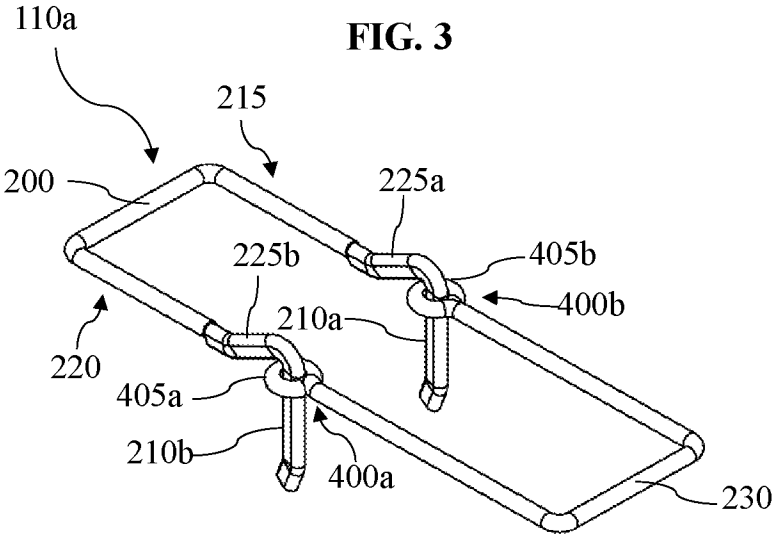
FIG. 4 illustrates a perspective view of the veneer tie showing the legs of the veneer tie extending through the eyes of the receiving portion, in accordance with an embodiment of the present invention.
Figure 5:
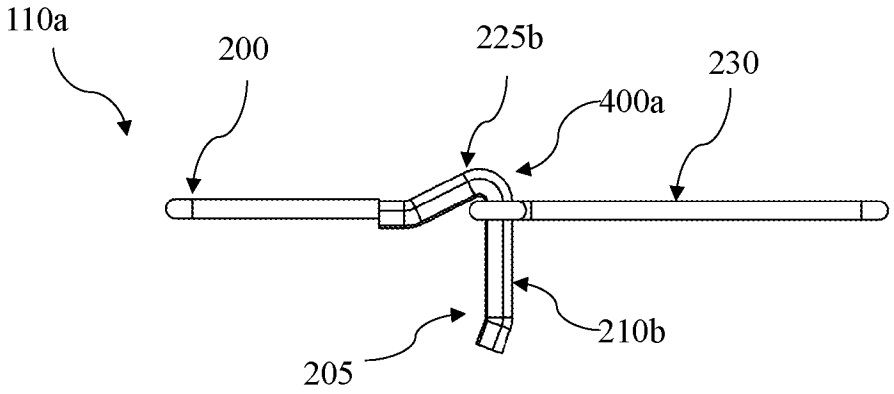
FIG. 5 illustrates a side view of the veneer tie showing the legs of the veneer tie extending through the eyes of the receiving portion, in accordance with an embodiment of the present invention.

Referring now to FIGS. 2-4, the anchoring system 100 includes a veneer tie 110*a* that is received by a wall anchor 230 that fixedly attaches to the inner wythe 125. In some embodiments, the wall anchor 230 may have an elongated U-shape. However, other reinforcing shapes known in the art of wall anchors may also be used. For example, the wall anchor can be a triangular or circular closed loop that partially embeds into a drywall or other solid inner wythe structure. Suitable materials for the wall anchor 230 may include, without limitation, iron, steel, metal alloys, and a semi-rigid polymer.

As FIG. 2-4 shows, the wall anchor 230 includes at least one receiving portion 400*a*, 400*b* disposed horizontally inside the cavity. The receiving portion 400*a-b* is disposed at the terminal end of the wall anchor, distal to the inner wythe 125. In some embodiments, the receiving portion 400*a-b* defines an eye 405*a*, 405*b*, a circle, an oval, a closed loop, or other ring-like shapes. However, it is understood that other shapes of the wall anchor and the receiving portion may be used and are within the sprit and scope of the present invention. As described below, the generally ring-shape receiving portion 400*a-b* is sized and dimensioned to snugly receive a first leg 210*a* and second leg 210*b* from the veneer tie 110*a*. In the present embodiment, the receiving portion of the wall anchor is configured to contact at least certain portions of the perimeter of asymmetrical transverse cross-section of the legs.

Figure 2B:
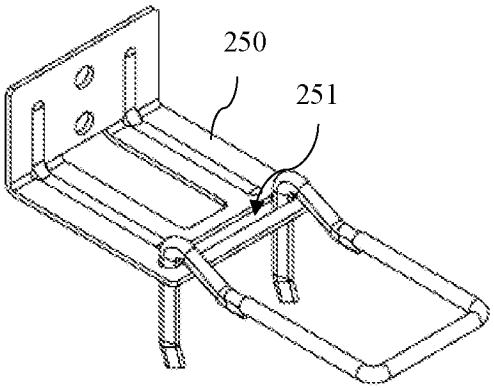
FIG. 2B illustrates perspective view of the veneer wall anchoring system where the receiving portion is a plate having a single a single eyelet, in accordance with an embodiment of the present invention.
Figure 2A:
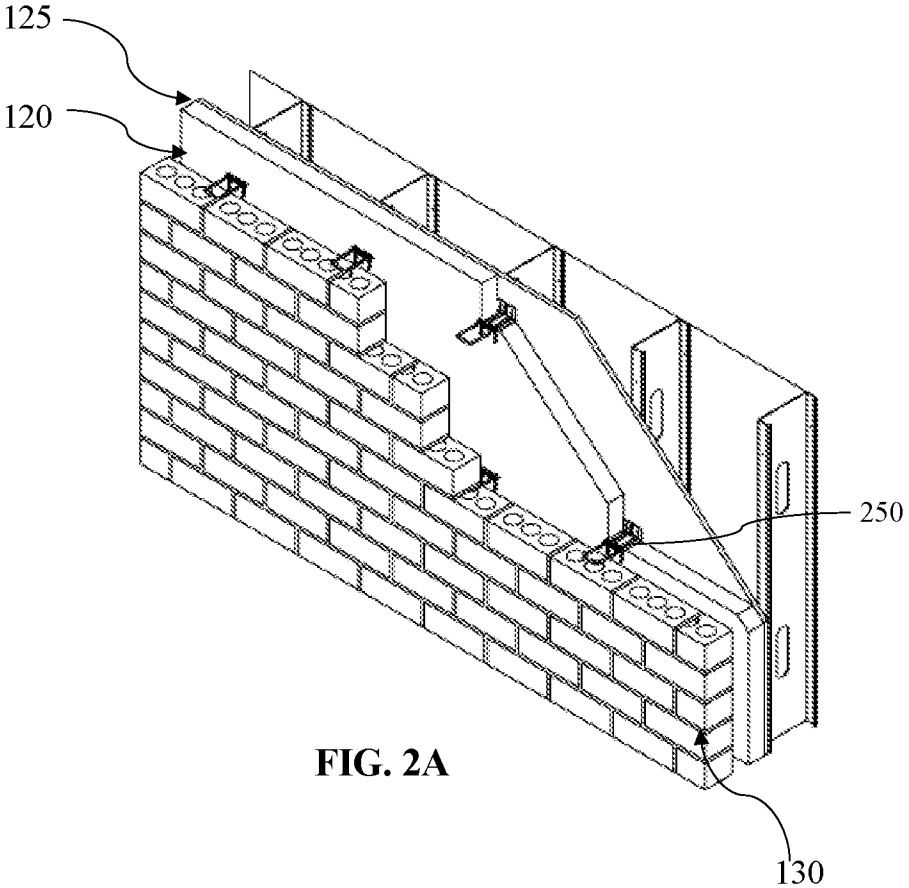
FIG. 2A illustrates perspective view of the veneer wall anchoring system disposed between the inner wythe and outer wythe where the receiving portion is a plate having a single a single eyelet, in accordance with an embodiment of the present invention.

In some embodiments, the legs of the veneer tie may be disposed in only a single eyelet (further explained below). FIG. 2A illustrates perspective view of the veneer wall anchoring system disposed in the cavity 120 between the inner wythe 125 and outer wythe 130. In FIG. 2A the receiving portion is a plate 250 having a single eyelet 251, in accordance with an embodiment of the present invention. FIG. 2B illustrates a closer perspective view of the veneer wall anchoring system where the receiving portion is a plate 250 having a single eyelet 251 defined as a slot in the body of the plate, in accordance with an embodiment of the present invention. It is understood that the legs of the veneer tie (as further explained below) may be inserted in the single elongated eyelet 251. In such embodiments, the transverse first cross-section of the legs that may engage or abut the walls of the slot surrounding the eyelet providing a snug or friction fit. The plate is generally horizontally arranged. The vertically arranged legs are configured to be inserted into the single elongated shaped eyelet of the receiving portion of the plate. It is understood that other embodiments of the shape of the eyelet may be used. For example, the plate may be arranged and configured such that the plate has two eyelets (i.e., FIGS. 2-4). The outside surfaces of the legs (and in some embodiments, more specifically the first transverse cross-section) are configured to abut the inward facing wall of the receiving section surrounding the eyelet(s) so that the legs create a friction fit and provide a certain amount of strength, and more specifically and increased amount of strength than if the first-transverse had a symmetrical transverse cross-section.

In some embodiments, the veneer tie 110*a* comprises a first end portion 200 disposed in a bed joint 600 of the outer wythe 130. In this arrangement, the first end portion 200 is the portion of the veneer tie that engages the outer wythe 130, or veneer wall. In some embodiments, the first end portion 200 may have an elongated U-shape. Suitable materials for the first end portion 200 may include, without limitation, iron, steel, metal alloys, and a semi-rigid polymer. In the present embodiment, the first end portion is an elongated shaped body having a symmetrical transverse cross-section that is generally circular. However, it is understood that other shapes that may be used to be embedded within the outer wythe may be used and are within the spirit and scope of the present invention.

The veneer tie 110*a* also comprises a second end portion 205, oppositely disposed, and arranged orthogonal to the first end portion 200. In some embodiments, the second end portion 205 includes a first leg 210*a* and an opposing, and parallel second leg 210*b*. The first leg 210*a* and the second leg 210*b* are vertically arranged, relative to the wall system 105. In other embodiments, the legs 210*a-b* extend into the cavity 120 between the inner and outer wythes 125, 130. In alternative embodiments, the veneer tie 110*a* may utilize more than two legs.

Figure 6:
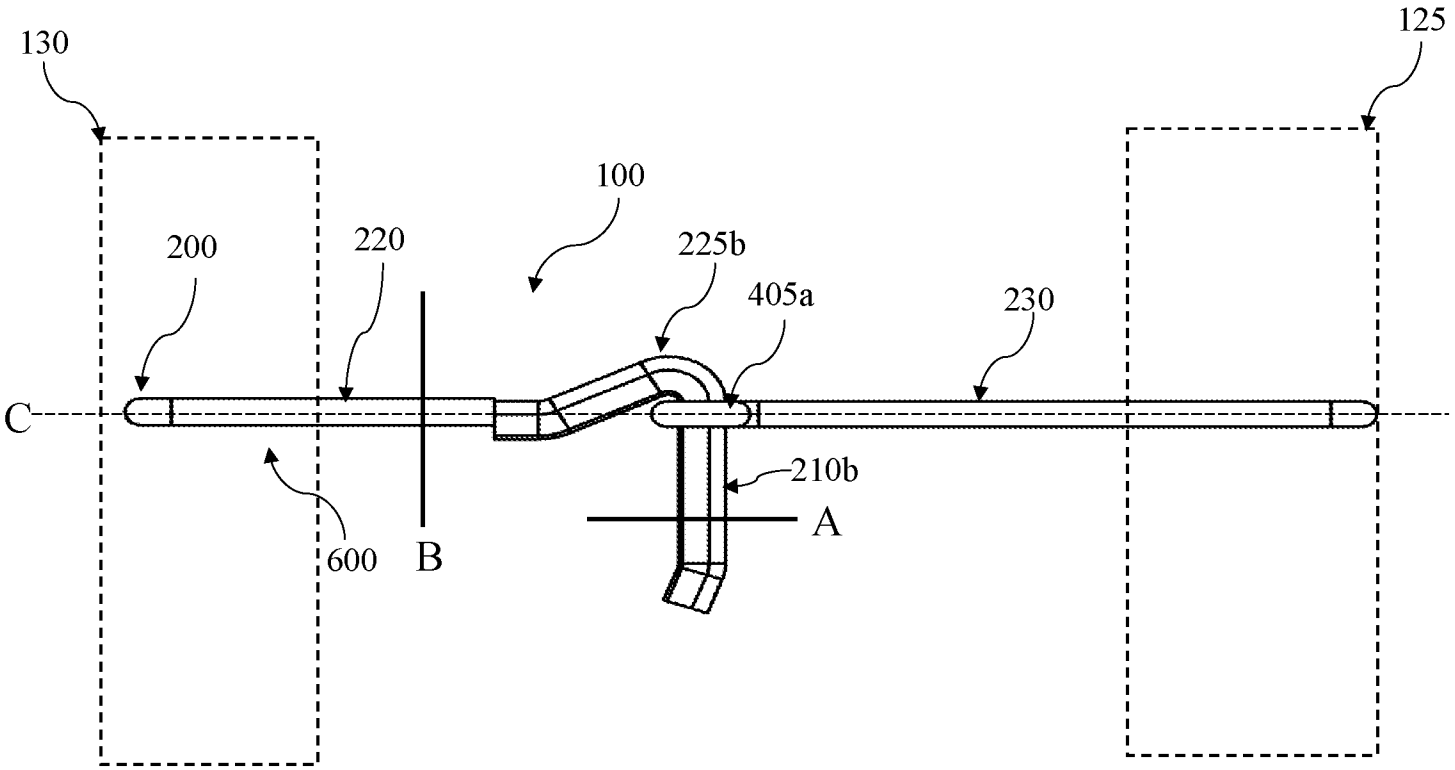
FIG. 6 illustrates a side view of the first portion of the veneer tie embedded into the bed of the outer wythe, and the wall anchor embedded into the bed of the inner wythe, in accordance with an embodiment of the present invention.

As FIGS. 7-12 reference, the first leg 210*a* and the second leg 210*b* are defined by a first transverse cross section 700. Those skilled in the art will recognize that such a cross section is the shape that is visible when taking a cross-section made at a right angle to the longitudinal of the legs 210*a-b*. FIG. 6 shows line A that along which the cross-sectional may be taken from. It is understood that in the present embodiment, the entire the vertically arranged legs define the first transverse cross-section having an asymmetrical shape. In other embodiments, the vertically arranged legs only have certain portions having the first transverse cross-section having an asymmetrical shape. The asymmetrical shape is significant in that the legs couple to the wall anchor. The asymmetrical configuration of the legs strengthens the connectivity with the eye, and thereby the wall anchor. For example, FIG. 4 illustrates the first portion coupled to the wall anchor, showing the legs passing through the eyes of the receiving portion. It is understood that the first transverse cross section may be the cross-sectional shape for all or a portion of each of the vertically arranged legs.

Referring to FIGS. 7-12, it is understood that the first side of first transverse cross section is on one side of midline 720 and the second side of first transverse cross section is on the other side of midline 720. Line 720 divides the first transverse cross section into two sections having equal first lengths. Line C also divides the first transverse cross section into two sections having equal widths. As will be further explained below, the embodiments illustrated in FIGS. 7-12 illustrate that the first transverse cross section first side is not symmetrical with the first transverse cross section second side. It is also understood that in FIGS. 7-12, the first sides (705*a*, 805*a*, 905*a*, 1005*a*, 1105*a*, 1205*a*) of the legs (illustrated to the left of midline 720) are configured to be positioned proximate to the outer wythe 130 and first end portion 200, while and the second side (705*b*, 805*b*, 905*b*, 1005*b*, 1105*b*, 1205*b*) of the legs (illustrated to the right of the midline 720) are configured to be proximate to the inner wythe 125. This asymmetrical shape provides an increase amount of strength of the legs over the strength provided by the rounded shape.

Various shapes and dimensions make up such an asymmetrical configuration. In some embodiments, the first transverse cross section 700 comprises a first transverse cross section first side 705*a*, and a first transverse cross section second side 705*b*. In one non-limiting embodiment, the first transverse cross section second side 705*b* is arranged such that it is distal to the first end portion 200. The first transverse cross section first side 705*a* is proximal to the first end portion 200.

In another possible embodiment, the first transverse cross section first side 705*a* and the first transverse cross section second side 705*b* are on opposing sides of midline 720. In one non-limiting embodiment, the midline 720 is defined as a line that arranges the sides 705*a*, 705*b* into equal lengths of the cross section for the legs. It is significant to note that each first transverse cross section side 705*a*, 705*b* is asymmetrical to the other. Thus, on each side of the midline 720, is a cross sectional shape; and each shape differs in shape and/or dimension to the other.

Figure 7:
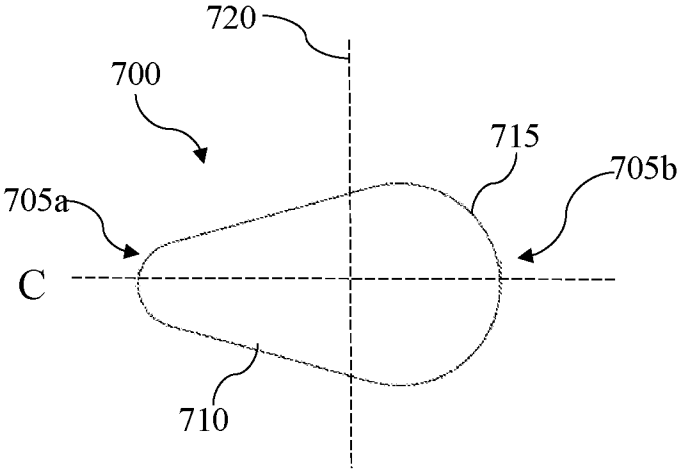
FIG. 7 illustrates a top cross-sectional view of a first embodiment illustrating an asymmetrical first transverse cross section of the legs, in accordance with an embodiment of the present invention.

An exemplary first transverse cross section is illustrated in FIG. 7. In this configuration, the first transverse cross section 700 of the legs 210*a-b* has a narrow first end and a wide second end. Also illustrated in the first transverse cross section 700 is a tapered section 710 on the first side that spans for an end of the first side and gets larges towards the second side. Additionally, the first transverse cross section 700 has a curved shaped 715 on the second side.

Figure 8:
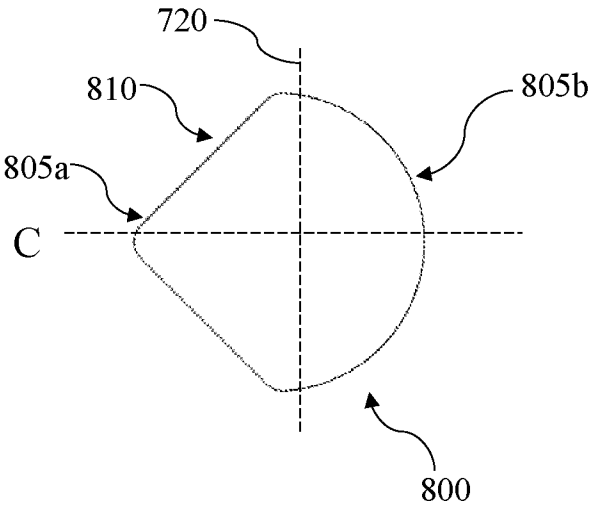
FIG. 8 illustrates a top cross-sectional view of a second embodiment illustrating an asymmetrical first transverse cross section of the legs, in accordance with an embodiment of the present invention.

Another variation of a first transverse cross section 800 is illustrated in FIG. 8. This version of cross section 800 for the legs is wider than the previous first transverse cross section 700. A first side 805*a* and a second side 805*b* are on either side of a midline 720, with each side being asymmetric to the other. As mentioned above, the midline is an imaginary line that divides the first side and second side such that the length of the first side and second side are generally equal. In the embodiment, of FIG. 8, a tapered section 810 is also disclosed. In both variations of cross sections, the connectivity between the eye 405*a-b* in the receiving portion and the legs is strengthened.

Figure 9:
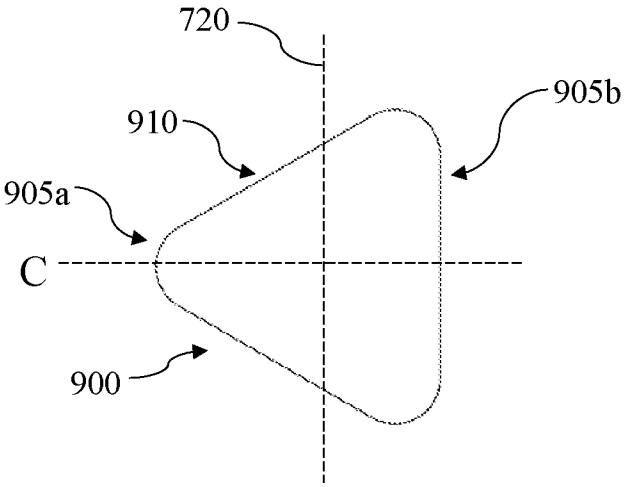
FIG. 9 illustrates a top cross-sectional view of a third embodiment illustrating an asymmetrical first transverse cross section of the legs, in accordance with an embodiment of the present invention.

FIG. 9 illustrates a top cross-sectional view of a third embodiment illustrating an asymmetrical first transverse cross section of the legs, in accordance with an embodiment of the present invention. FIG. 9 illustrates yet another first transverse cross section. A first side 905*a* and a second side 905*b* are on either side of midline 720, with each side being asymmetric to the other. In this configuration, the first transverse cross section 900 of the legs 210*a-b* has a generally triangular shape, with a tapered portion 910 sloping from the second side 905*b* to the first side 905*a*. It is understood the term asymmetrical means failing to correspond to one another in shape and that are not symmetrical.

Figure 10:
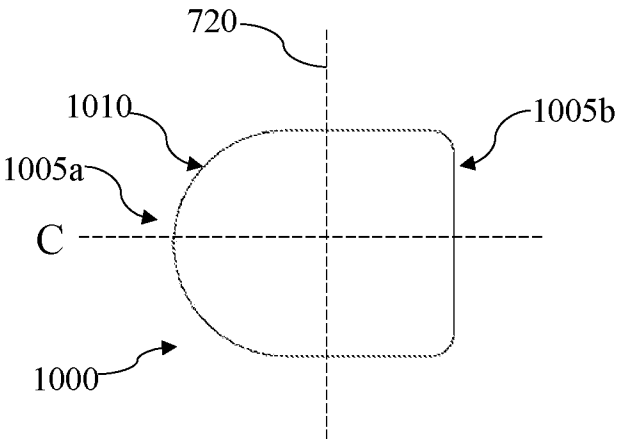
FIG. 10 illustrates a top cross-sectional view of a fourth embodiment illustrating an asymmetrical first transverse cross section of the legs, in accordance with an embodiment of the present invention.

FIG. 10 illustrates a top cross-sectional view of a fourth embodiment illustrating an asymmetrical first transverse cross section 1000 of the legs, in accordance with an embodiment of the present invention. This embodiment of cross section 1000 is uniform across the longitudinal, with the first side having a rounded portion 1010. In this arrangement, a first side 1005*a* and a second side 1005*b* are on either side of midline 720, with each side being asymmetric to the other. In this variation of the cross section, the connectivity between the eye 405*a-b* in the receiving portion and the legs 210*a-b* is strengthened.

Figure 11:
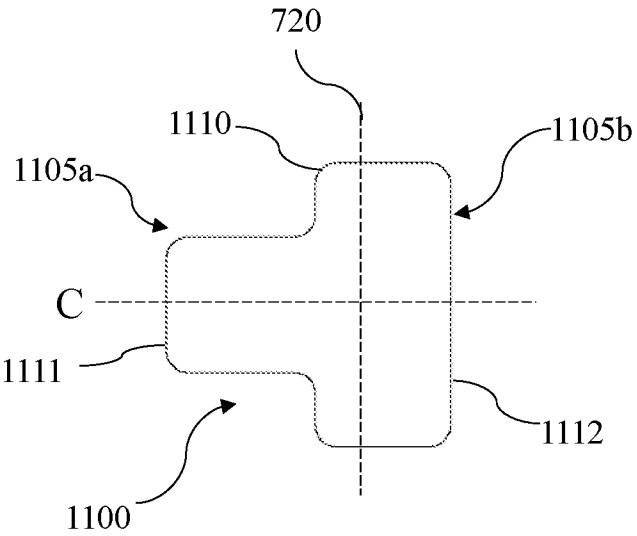
FIG. 11 illustrates a top cross-sectional view of a fifth embodiment illustrating an asymmetrical first transverse cross section of the legs, in accordance with an embodiment of the present invention.

FIG. 11 illustrates a top cross-sectional view of a fifth embodiment illustrating an asymmetrical first transverse cross section 1100 of the legs, in accordance with an embodiment of the present invention. FIG. 11 illustrates another variation of a first transverse cross section 1100. In this configuration, the cross section 1100 has a T-shape with a pronounced shoulder portion 1110. In this arrangement, a first side 1105*a* and a second side 1105*b* are on opposing sides of midline 720, with each side being asymmetric to the other. In this variation of the cross section, the connectivity between the eye 405*a-b* in the receiving portion and the legs 210*a-b* is strengthened. In the present embodiment, the cross-section defines a shoulder 1110 that connects a portion 1111 having a smaller width than the width of portion 1112.

Figure 12:
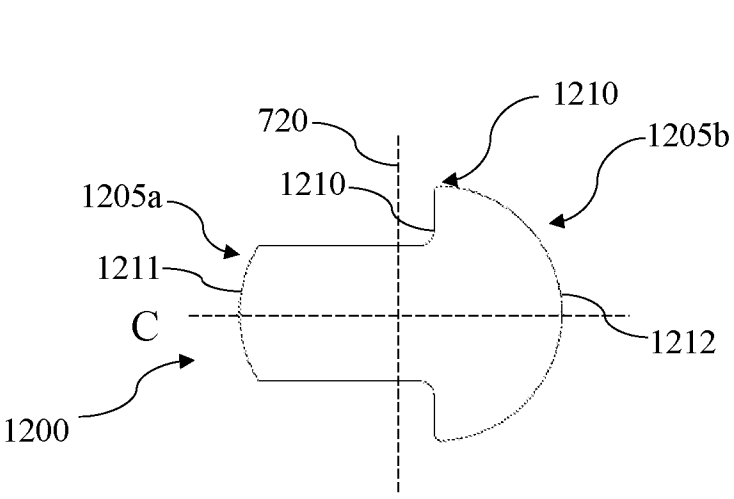
FIG. 12 illustrates a top cross-sectional view of a sixth embodiment illustrating an asymmetrical first transverse cross section of the legs, in accordance with an embodiment of the present invention.

FIG. 12 illustrates a top cross-sectional view of a sixth embodiment illustrating an asymmetrical first transverse cross section 1200 of the legs, in accordance with an embodiment of the present invention. First transverse cross section 1200 generally defines a T-shape body with a rounded second side 1205*b* and a smaller rounded first side 1205*a*, creating a pronounced rounded shoulder portion 1210. Shoulder connects the body 1211 of the first side with the body 1212 of the second side. The cross section 1200 is bifurcated by the midline 720. While the aforementioned cross sections are described, any asymmetrical dimensions may be utilized across the legs of the veneer tie. In any matter, it is significant to note that the shoulders, curved portions, and tapers work together to strength the connection of the legs in the eye of the receiving portion.

In such asymmetric configurations, the first transverse cross section 700 is introduced inside of the eye 405*a-b* that forms in the receiving portion 400*a-b* of the wall anchor 230. This creates a snug relationship, with multiple contact points between the legs 210*a-b* and the inner surface of the eye 405*a-b*. In essence, the asymmetric shape strengthens the connection therebetween. However, as mentioned above, the legs may be introduced into a single eyelet, such as illustrated in FIGS. 2A and 2B.

Referring back to FIG. 3, the veneer tie 110*a* also comprises a first arm 215 and a second arm 220 that are integral with the first end portion 200. The arms 215, 220 are horizontally arranged, relative to the wall system 105 (See FIG. 2). In one embodiment, a first end 300*a* of the first arm 215, and a first end 305*a* of the second arm 220 are adjoined to the first end portion 200 of the veneer tie 110*a*. Suitable materials for the arms 215, 220 may include, without limitation, iron, steel, metal alloys, and a semi-rigid polymer.

Figure 13:
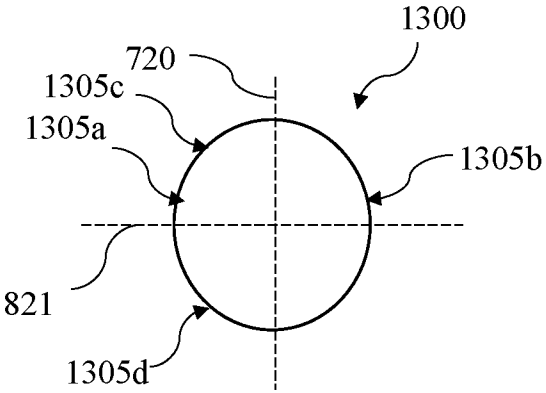
FIG. 13 illustrates a side cross-sectional view of symmetrical second transverse cross section of the arms of the veneer, in accordance with an embodiment of the present invention.

Turning now to FIG. 13, the first arm 215 and the second arm 220 define a second transverse cross section 1300. FIG. 6 illustrates line B which is the position of the arm along which the cross-sectional view of FIG. 13 is taken from. The second transverse cross section 1300 is different than the first transverse cross section 700 of the legs 210*a-b*. For example, the second transverse cross section 1300 is symmetrical or has at least two lines of symmetry and defines as a circular shape. FIG. 13 also illustrates the midline 720 that divides the cross-section into two sides having equal distances, namely a first side 1305*a* and a second side 1305*b*. Line 821 is a second midline that divides the second cross section into another two equal portions, namely sides 1305*c* and 1305*d*. The second transverse cross-section has at least two lines of symmetry. A difference between the first transverse sections illustrated in FIGS. 7-8 and 10-12 and the second transverse cross section 1300 is that second transverse cross section has symmetry on at least two lines of symmetry namely, line 720 and 821; while, however the first cross transverse cross-sections illustrated in FIGS. 7-8 and 10-12 do not have symmetry on both lines of symmetry. Stated differently, second transverse cross section has at least two lines of symmetry while the first transverse cross section has at most one line of symmetry as illustrated in FIGS. 7-8 and 10-12. Additionally, as shown in FIGS. 7-10 and 10-12, the first transverse cross section has symmetry along line C. However, the shapes of the first transverse cross section do not have a second line of symmetry along midline 720. Additionally, FIG. 9 also is asymmetrical as it related to midline 720. In other words, even though the first side 905*a* and the second side 905*b* (on either side of midline 720) have an equal length, the shape of first side 905*a* and the second side 905*b* are not symmetrical.

The second end portion 205 also includes a joint portion 225*a*, 225*b*. The joint portion 225*a-b* may include a pair of parallel crossbars that serve as a nexus, joining a second end 300*b* of the first arm 215 and a second end 305*b* of the second arm 220 to an upper end 310*a* of the first leg 210*a* and an upper end 310*b* of the second leg 210*b*, respectively. Suitable materials for the joint portion 225*a-b* may include, without limitation, iron, steel, metal alloys, and a semi-rigid polymer. The joint portion may extend upward a horizontally arranged arm to the upper portion to the leg. The joint portion may also have a transverse cross section that has the same shape of the first transverse cross section. Additionally, in some embodiments, the joint portion may also have a portion that has a transverse cross section that defines a shape that is the same as the second transverse cross section.

A method of use comprises an initial step of identifying a wall system having an inner wythe and an outer wythe, and that requires strengthening of the wythes. Next, a veneer tie having a first portion, a second portion, and a wall anchor is oriented along the wall system, such that the first portion is proximal to the outer wythe. A vertically disposed first leg and second leg, extending from the second portion, are introduced into a receiving portion from the anchor wall. Due to the asymmetrical cross section of the legs (where the legs only have a transverse cross-section having at most one line of symmetry), a snug fit occurs as the eyes of the receiving portion receive the legs. The lower exposed section of the legs are then inserted into a cavity that forms between the inner and outer wythes. The horizontal arms that make up the first portion rest across the top surface of the outer wythe. The horizontal anchor wall rests across the top surface of the outer wythe.

In conclusion, veneer wall anchoring system provides an asymmetrical veneer tie that connects an outer wythe, such as masonry veneer wall, to an inner wythe. A wall anchor fixedly attaches to the inner wythe. The wall anchor has a receiving portion. The veneer tie includes a first end portion disposed in the outer wythe. The veneer tie also includes a second end portion having a first leg and a second leg. The first and second leg comprise a first transverse cross section that defines a first transverse cross section first side and a first transverse cross section second side, which are asymmetrical to each other. The legs, and thereby the first transverse cross section is introduced into receiving portion of wall anchor. The asymmetric shape strengthens the connection therebetween. The second end portion also has a first arm and a second arm, which join with first end portion of veneer tie.

These and other advantages of the invention will be further understood and appreciated by those skilled in the art by reference to the following written specification, claims and appended drawings. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A veneer tie comprising:

a. a first end portion for being disposed in a bed joint of an outer wythe;

b. a second end portion defining a first leg and a second leg, wherein the first leg and the second leg are vertically arranged, wherein the first leg and the second leg comprise a first transverse cross section having a first transverse cross section first side proximate to the first end portion and a first transverse cross section second side distal to the first end portion, and wherein the first transverse cross section first side has a maximum width less than a maximum width of the first transverse cross section second side;

c. a first arm and a second arm, wherein the first arm and the second arm are horizontally arranged, wherein the first arm and the second arm comprise a second transverse cross section, wherein the second transverse cross section is different than the first transverse cross section, wherein a first end of the first arm and a first end of the second arm is adjoined to the first end portion; and d. a joint portion adjoining a second end of the first arm and a second end of the second arm to an upper end of the first leg and an upper end of the second leg, respectively.

2. The veneer tie of claim 1, the first transverse cross section defines a tapered section on the first transverse cross section first side.

3. The veneer tie of claim 1, the first transverse cross section defines a curved shaped on the second side.

4. The veneer tie of claim 1, wherein the second transverse cross section defines a symmetrical shape having a second transverse cross section first side and a second transverse cross section second side, wherein the second transverse cross section first side and the second transverse cross section second side are symmetrical.

5. An anchoring system for use in a wall system, the wall system having a cavity between an inner wythe and an outer wythe, wherein the anchoring system comprises:

a. a wall anchor configured to be fixedly attached to said inner wythe and having at least one receiving portion having an eye configured to be disposed in the cavity;

b. a veneer tie received by the at least one receiving portion, the veneer tie comprising:

i. a first end portion for being disposed in a bed joint of the outer wythe;

ii. a second end portion defining at least one leg, wherein the at least one leg is vertically arranged, wherein the at least one leg comprises a first transverse cross section having a first transverse cross section first side proximate to the first end portion and a first transverse cross section second side distal to the first end portion; and wherein first transverse cross section first side has a maximum width less than a maximum width of the first transverse cross section second side;

iii. at least one arm, wherein the at least one arm is horizontally arranged, wherein a first end of the at least one arm is adjoined to the first end portion; and, iv. a joint portion adjoining a second end of the at least one arm to an upper end of the at least one leg; and c. wherein the first transverse cross section is arranged inside of the at least one receiving portion.

6. The anchoring system of claim 5, the first transverse cross section defines a tapered section on the first side.

7. The anchoring system of claim 5, the first transverse cross section defines a curved shaped on the second side.

8. A veneer tie comprising:

a. a first end portion for being disposed in a bed joint of an outer wythe;

b. a second end portion defining a leg, wherein the leg is vertically arranged, wherein the leg comprises a first transverse cross section having a first transverse cross section first side that is proximate to the first end portion and a first transverse cross section second side distal to the first end portion, and wherein first transverse cross section first side has a maximum width less than a maximum width of the first transverse cross section second side;

c. an arm, wherein the arm is horizontally arranged, wherein a first end of the arm is adjoined to the first end portion; and d. a joint portion adjoining a second end of the arm to an upper end of the leg.

9. The veneer tie of claim 8, the first transverse cross section defines a tapered section on the first transverse cross section first side.

10. The veneer tie of claim 8, the first transverse cross section defines a curved shaped on the first transverse cross section second side.

* * * * *